US008512116B2

(12) United States Patent
Haushalter

(10) Patent No.: US 8,512,116 B2
(45) Date of Patent: Aug. 20, 2013

(54) METHODS OF MANAGING PLAY OF WAGERING GAMES AND SYSTEMS FOR MANAGING PLAY OF WAGERING GAMES

(75) Inventor: Todd M. Haushalter, Las Vegas, NV (US)

(73) Assignee: SHFL entertainment, Inc., Las Vegas, NV (US)

( * ) Notice: Subject to any disclaimer, the term of this patent is extended or adjusted under 35 U.S.C. 154(b) by 0 days.

(21) Appl. No.: 13/215,125

(22) Filed: Aug. 22, 2011

(65) Prior Publication Data

US 2013/0053116 A1 Feb. 28, 2013

(51) Int. Cl.
*A63F 1/00* (2006.01)

(52) U.S. Cl.
USPC ..... 463/13; 273/292

(58) Field of Classification Search
USPC ..... 273/274, 292; 463/11, 13
See application file for complete search history.

(56) References Cited

U.S. PATENT DOCUMENTS

| | | | |
|---|---|---|---|
| 3,667,757 | A | 6/1972 | Holmberg |
| 3,876,208 | A | 4/1975 | Wachtler et al. |
| 3,939,953 | A | 2/1976 | Miyazawa |
| 4,305,586 | A | 12/1981 | Richards et al. |
| 4,593,904 | A | 6/1986 | Graves et al. |
| 4,651,997 | A | 3/1987 | Wood et al. |
| 4,652,998 | A | 3/1987 | Koza et al. |
| 4,659,087 | A | 4/1987 | Shen et al. |
| 4,743,022 | A | 5/1988 | Wood |
| 4,756,531 | A | 7/1988 | Dire et al. |
| 4,807,884 | A | 2/1989 | Breeding |
| 4,813,675 | A | 3/1989 | Greenwood et al. |
| 4,836,546 | A | 6/1989 | Dire et al. |
| 4,836,553 | A | 6/1989 | Suttle et al. |
| 4,837,728 | A | 6/1989 | Barrie et al. |
| 4,842,276 | A | 6/1989 | Darby |

(Continued)

FOREIGN PATENT DOCUMENTS

| | | |
|---|---|---|
| AU | 200135060 | 6/2001 |
| EP | 0443420 | 8/1991 |

(Continued)

OTHER PUBLICATIONS

"Hoyle's Rules of Games", pp. 75-102 by Morehead and Mot Smith, 1963.

(Continued)

*Primary Examiner* — Dmitry Suhol
*Assistant Examiner* — Jason Yen
(74) *Attorney, Agent, or Firm* — TraskBritt

(57) ABSTRACT

Poker card game deals four cards to a player, four cards to a dealer, and three community cards. Player discards one card and bets 1×-4× ante wager. After a first community card is exposed, player bets 1×-3× ante wager. After a second community card is exposed, player bets 1×-2× ante wager. A final community card is exposed. Dealer reveals dealer's best five-card poker hand formed from any of dealer's four cards and three community cards, and player reveals player's best five-card poker hand formed from any of player's three cards and three community cards. Highest ranking hand wins. Pays ante wagers according to a paytable. Pays even money on play wagers. Allows side wager that pays according to a paytable. Played with one deck of cards. Includes card game method, device-readable storage medium containing device-executable code, and device-executable code stored on a device-readable storage medium.

24 Claims, 8 Drawing Sheets

(56) References Cited

U.S. PATENT DOCUMENTS 4,861,041 A 8/1989 Jones et al.
4,882,473 A 11/1989 Bergeron et al.
4,906,005 A 3/1990 Manabe et al.
4,948,134 A 8/1990 Suttle et al.
5,019,973 A 5/1991 Wilcox et al.
5,022,653 A 6/1991 Suttle et al.
5,042,635 A 8/1991 Bell et al.
5,042,818 A 8/1991 Weingardt et al.
5,046,736 A 9/1991 Bridgeman et al.
5,078,405 A 1/1992 Jones et al.
5,087,405 A 2/1992 Maker et al.
5,098,107 A 3/1992 Boylan et al.
5,100,137 A 3/1992 Fulton et al.
5,112,060 A 5/1992 Jones et al.
5,114,155 A 5/1992 Tillery et al.
5,116,055 A 5/1992 Tracy et al.
5,154,429 A 10/1992 Levasseur et al.
5,167,413 A 12/1992 Fulton et al.
5,174,579 A 12/1992 Griffiths
5,221,083 A 6/1993 Dote et al.
5,242,163 A 9/1993 Fulton et al.
5,248,142 A 9/1993 Breeding et al.
5,251,897 A 10/1993 Fulton et al.
5,255,915 A 10/1993 Miller
5,257,784 A 11/1993 Boylan et al.
5,257,810 A 11/1993 Schorr et al.
5,265,877 A 11/1993 Boylan et al.
5,275,400 A 1/1994 Weingardt et al.
5,275,415 A 1/1994 Wisted et al.
5,288,077 A 2/1994 Jones et al.
5,288,081 A 2/1994 Breeding et al.
5,294,128 A 3/1994 Marquez et al.
5,308,065 A 5/1994 Bridgeman et al.
5,322,295 A 6/1994 Cabot et al.
5,326,104 A 7/1994 Pease
5,364,104 A 11/1994 Jones et al.
5,364,105 A 11/1994 Jones et al.
5,366,228 A 11/1994 Kangsanaraks et al.
5,377,973 A 1/1995 Jones et al.
5,377,994 A 1/1995 Jones et al.
5,382,025 A 1/1995 Sklansky et al.
5,393,067 A 2/1995 Paulsen et al.
5,395,120 A 3/1995 Malek et al.
5,397,128 A 3/1995 Hesse et al.
5,411,257 A 5/1995 Fulton et al.
5,417,430 A 5/1995 Breeding et al.
5,423,551 A 6/1995 Stavinsky et al.
5,431,408 A 7/1995 Adams et al.
5,437,451 A 8/1995 Fulton et al.
5,437,462 A 8/1995 Breeding et al.
5,472,194 A 12/1995 Breeding et al.
5,489,101 A 2/1996 Moody et al.
5,494,295 A 2/1996 Potter et al.
5,505,449 A 4/1996 Eberhardt et al.
5,531,448 A 7/1996 Moody et al.
5,538,252 A 7/1996 Green et al.
5,544,892 A 8/1996 Breeding et al.
5,549,300 A 8/1996 Sardarian et al.
5,584,486 A 12/1996 Franklin et al.
5,597,162 A 1/1997 Franklin et al.
5,630,586 A 5/1997 Lowden
5,630,757 A 5/1997 Gagin et al.
5,636,842 A 6/1997 Cabot et al.
5,653,444 A 8/1997 Dahl et al.
5,657,993 A 8/1997 Merlino et al.
5,660,393 A 8/1997 Dreger et al.
5,669,817 A 9/1997 Tarantino et al.
5,673,917 A 10/1997 Vancura et al.
5,685,774 A 11/1997 Webb et al.
5,697,614 A 12/1997 Potter et al.
5,711,525 A 1/1998 Breeding et al.
5,718,430 A * 2/1998 Aramapakul et al. ..... 273/292
5,732,950 A 3/1998 Moody et al.
5,743,800 A 4/1998 Huard et al.
5,752,702 A 5/1998 McDoniel et al.
5,762,340 A 6/1998 Feola et al.
5,769,422 A 6/1998 Stromer et al.
5,775,992 A 7/1998 Wood et al.
5,820,460 A 10/1998 Fulton et al.
5,839,732 A 11/1998 Guidi et al.
5,845,906 A 12/1998 Wirth et al.
5,848,932 A 12/1998 Adams et al.
5,851,011 A 12/1998 Lott et al.
5,871,213 A 2/1999 Chadband et al.
5,897,436 A 4/1999 Singer et al.
5,901,958 A 5/1999 Andrews et al.
5,928,081 A 7/1999 Bochichio et al.
5,941,769 A 8/1999 Order et al.
5,947,821 A 9/1999 Stone
5,957,459 A 9/1999 Chae et al.
5,975,529 A 11/1999 De Keller et al.
5,979,897 A 11/1999 Grossman et al.
5,984,309 A 11/1999 Santin et al.
5,984,310 A 11/1999 English et al.
5,988,643 A 11/1999 Awada et al.
5,997,002 A 12/1999 Goldman et al.
6,012,719 A 1/2000 Webb et al.
6,019,374 A 2/2000 Breeding et al.
6,027,119 A 2/2000 De Lisle
6,036,190 A 3/2000 Edmunds et al.
6,042,118 A 3/2000 Poitra et al.
6,056,641 A 5/2000 Webb et al.
6,062,564 A 5/2000 Terminel et al.
6,102,402 A 8/2000 Scott et al.
6,113,101 A 9/2000 Wirth et al.
6,113,103 A 9/2000 Mostashari et al.
6,126,166 A 10/2000 Lorson et al.
6,149,154 A 11/2000 Grauzer et al.
6,170,827 B1 1/2001 Lombardo et al.
6,196,918 B1 3/2001 Miers et al.
6,206,373 B1 3/2001 Garrod
6,206,780 B1 3/2001 Awada
6,229,534 B1 5/2001 Gerra et al.
6,234,485 B1 5/2001 Perkins
6,237,916 B1 5/2001 Webb
6,254,096 B1 7/2001 Grauzer et al.
6,273,424 B1 8/2001 Breeding
6,279,910 B1 8/2001 de Keller
6,299,534 B1 10/2001 Breeding et al.
6,313,871 B1 11/2001 Schubert
6,334,614 B1 1/2002 Breeding
6,345,823 B1 2/2002 Webb
6,375,189 B1 4/2002 Jones
6,406,024 B1 6/2002 Perkins
6,428,005 B2 8/2002 Au-Yeung
6,454,266 B1 9/2002 Breeding et al.
6,460,848 B1 10/2002 Soltys et al.
6,467,771 B1 10/2002 deKeller
6,474,644 B1 11/2002 Pickle et al.
6,517,072 B1 2/2003 McInerney
6,533,279 B2 3/2003 Moody et al.
6,561,897 B1 5/2003 Bourbour et al.
6,581,936 B1 6/2003 Zoccolillo et al.
6,607,443 B1 8/2003 Miyamoto et al.
6,637,746 B1 10/2003 Baranauskas
6,637,747 B1 10/2003 Garrod
6,651,981 B2 11/2003 Grauzer et al.
6,679,492 B2 1/2004 Markowiak
6,698,759 B2 3/2004 Webb et al.
6,705,943 B2 3/2004 Awada
6,719,291 B1 4/2004 deKeller
6,752,394 B2 6/2004 Malcolm
6,827,348 B1 12/2004 Mitchell
6,896,265 B1 5/2005 Schlumbrecht
6,976,589 B2 12/2005 De Raedt et al.
6,986,514 B2 1/2006 Snow
D518,112 S 3/2006 Abbott et al.
7,029,011 B2 4/2006 Strong et al.
7,140,614 B2 11/2006 Snow
7,175,522 B2 2/2007 Hartl
D542,858 S 5/2007 Looney et al.
7,246,799 B2 7/2007 Snow
D548,799 S 8/2007 Looney et al.
7,261,298 B1 8/2007 Schlumbrecht

| | | | | |
|---|---|---|---|---|
| 7,264,243 | B2 | 9/2007 | Yoseloff et al. | |
| 7,389,989 | B1 * | 6/2008 | Hong | 273/274 |
| 7,510,191 | B1 | 3/2009 | Schlumbrecht | |
| 7,510,193 | B1 | 3/2009 | Schlumbrecht | |
| 7,537,456 | B2 | 5/2009 | Snow | |
| 7,584,966 | B2 | 9/2009 | Snow | |
| 7,611,404 | B1 | 11/2009 | Hilf et al. | |
| 7,628,689 | B2 | 12/2009 | Snow | |
| 7,661,676 | B2 | 2/2010 | Smith et al. | |
| 7,722,048 | B2 | 5/2010 | Smith et al. | |
| 7,874,901 | B2 | 1/2011 | Kirkpatrick | |
| 2001/0040345 | A1 | 11/2001 | Au-Yeung | |
| 2001/0048197 | A1 | 12/2001 | Lo | |
| 2002/0008356 | A1 * | 1/2002 | De Keller | 273/292 |
| 2002/0103018 | A1 | 8/2002 | Rommerdahl et al. | |
| 2002/0175468 | A1 | 11/2002 | Kenny et al. | |
| 2002/0195775 | A1 | 12/2002 | Webb et al. | |
| 2003/0107176 | A1 | 6/2003 | Goldman et al. | |
| 2003/0199316 | A1 | 10/2003 | Miyamoto et al. | |
| 2004/0036217 | A1 | 2/2004 | Schlumbrecht | |
| 2004/0090006 | A1 * | 5/2004 | Foster et al. | 273/292 |
| 2004/0100025 | A1 | 5/2004 | Conklin et al. | |
| 2004/0150163 | A1 | 8/2004 | Kenny et al. | |
| 2004/0160006 | A1 | 8/2004 | Kenny et al. | |
| 2004/0178582 | A1 | 9/2004 | Garrod | |
| 2004/0217548 | A1 | 11/2004 | Snow | |
| 2004/0224777 | A1 | 11/2004 | Smith et al. | |
| 2005/0029744 | A1 | 2/2005 | Yoseloff et al. | |
| 2005/0051958 | A1 | 3/2005 | Snow | |
| 2005/0104292 | A1 | 5/2005 | Schultz | |
| 2005/0107148 | A1 | 5/2005 | Webb | |
| 2005/0164759 | A1 | 7/2005 | Smith et al. | |
| 2005/0164762 | A1 | 7/2005 | Smith et al. | |
| 2005/0242506 | A1 * | 11/2005 | Yoseloff | 273/292 |
| 2006/0001216 | A1 | 1/2006 | Strong | |
| 2006/0270477 | A1 | 11/2006 | Snow | |
| 2006/0281513 | A1 | 12/2006 | Kirkpatrick | |
| 2006/0284376 | A1 * | 12/2006 | Snow | 273/292 |
| 2007/0069470 | A1 * | 3/2007 | Snow | 273/292 |
| 2007/0075494 | A1 | 4/2007 | Abbott | |
| 2007/0298854 | A1 * | 12/2007 | Yoseloff et al. | 463/11 |
| 2008/0042355 | A1 | 2/2008 | Snow | |
| 2008/0108412 | A1 | 5/2008 | Snow et al. | |
| 2008/0224404 | A1 * | 9/2008 | Lo | 273/292 |
| 2009/0020950 | A1 * | 1/2009 | Faulkner | 273/292 |
| 2009/0029757 | A1 * | 1/2009 | Englman et al. | 463/13 |
| 2009/0121437 | A1 | 5/2009 | Snow et al. | |
| 2009/0124315 | A1 * | 5/2009 | Snow et al. | 463/13 |

FOREIGN PATENT DOCUMENTS

| | | |
|---|---|---|
| GB | 667345 | 2/1952 |
| GB | 94/14822 | 7/1994 |
| GB | 94/26324 | 12/1994 |

OTHER PUBLICATIONS

"Prime Table Games—Disclosure in Respect to Three Card Poker", Derek J. Webb, Author, Feb. 10, 1999.

"Community Card Poker," from Wikipedia, the free encyclopedia, http://en.wikipedia.org/wiki/Community_card_poker, Feb. 1, 2011.

"Declaration of Jim Kilby Under 37 CFR 1.132", 2 pages (May 9, 1995).

"Hoyle's Modern Encyclopedia of Card Games", Walter Gibson, 1993, p. 268-271. (not clearly readable).

"Poker is the name of the Game", Walter Gibson, 1974, Chapter VIII, Spit in the Ocean (not clearly readable).

Second Amended Petition filed in the Civil Action "In the Matter of the Petition of IGT for Certain Declaratory Rulings and for the Authorization for the Implementation of the Game of Progressive-21". pp. 1-9 (1992).

"Switch Dealer—Home Games of Community Card Poker," http://www.switchdealercom/home-games-community-card-poker.html, 2008.

"Wheel of Gold", Product Information published by Anchor Games, 11 pages (Oct. 1995).

"Wild Deuces", Michigan Legionaire, vol. XXXII, No. 10, 1 page, (Oct. 1978).

Card Craps, Scarne's Encyclopedia of Card Games, 1948, pp. 321-323.

Copyright filing with the Bureau voor de Intellectuele Eigendom, Aruba, Jan. 13, 1998, 13 pgs.

Fast Action Hold 'Em—New Jersey Gaming Jurisdiction Register, vol. 30, No. 14 (14 pages) (2005).

Flop-A-Lock (1 page) (2006).

Gaming Concepts Over/Under 13 Blackjack, 1988, 8 pages.

Gibson, W.B. (1974) Hoyle's Modern Encyclopedia of Card Games, pp. 252, 257, 258.

Gros, R., "Working Within the Systems", Casino Journal, vol. 8, No. 12, pp. 10-11, 13, 15, 4 (Dec. 1992).

Hoyles Modern Encyclopedia of Card Games by Walter Gibson, p. 250, 3 pages, 1993.

J. Scarne, "Scarne's Guide to Modern Poker", Constable and Company Limited, 1979, "Pokino", pp. 160-162.

John Scarne Games Inc., Scarne's Guide to Modern Poker, 1980, Draw Poker Variation of Spit in the Ocean, pp. 139-153.

KISS Guide to Gambling by John Marchel, DK Publishing, Inc., Glossary: No-Limit, 2001, p. 344.

New Jersey Register (vol. 30, No. 14, Jul. 20, 1998). Rule Adoption, Other Agencies, Cazsino Control Commission, Accounting and Controls, Gaming Equipment, Rules of the Games, Fast Action Hold'Em (pp. 1-15) (Westlaw 30 N.J.R. 2639 (b)). 2005 Thomson/West.

Published Rule Sheet for Casino Poker from Vegas World, 1982, p. 1.

Scarne, Jr., "Scarne's Encyclopedia of Games", Harper & Row Publishers, First Edition, "Pontoon", p. 288, "Scarney Baccarat"®, pp. 299-304, and "Three-In-One", p. 383, 1973.

Scarne, Jr.,"Scarne's Encyclopedia of Games", Harper & Row Publishers, First Edition, pp. 33-41, Stud Poker, 1973.

Scarne, Jr., "Scarne's Encyclopedia of Games", Harper & Row Publishers, First Edition, pp. 28-31, "Three-Card Poker", "Three-Card Monte", "Brag", 1973.

Scarne's Guide to Modern Poker, Constable and Company Limited, "Brag", 1980, pp. 159-160.

Show Five Cards, Scarne's Encyclopedia of Games, John Scarne, Harper & Row Publishers, 1973, p. 28-29.

Smith, C., "Bar Bosses See New Trivia Game Filling More Seats", The Vancouver Sun, 1 page (Feb. 21, 1990).

Three Card Poker Disclosure by Derek J. Webb (1992).

www.findarticles.com/p/articles/mi_m0EIN/is_2004_July_26/ai_n6122536/print; Mikohn Launches Texas Hold 'Em Bon Poker Table Game, 1 page (Jul. 26, 2004).

www.galaxygaming.com/texasshootout.html; Texas Shootout; 5 pages (2005).

www.lakesentertainment.com/games.wpt; World Poker Tour; 6 pages (2005).

www.oldvegaschips.com; Poker Rules & Poker Questions Answered; Texas Hold'em; Omaha High; Deuces Wild Poker; Caribbean Poker; Poker Rules, How to play poker, how to play Texas Hold'em Poker; 42 pages (accessed Mar. 10, 2006).

www.progressivegaming.net/pages/games/texasholdem.html; 2 pages (2005).

www.riversideresort.com/gaming/live-games Deuces Wild Hold 'Em Fold 'Em (4 pages) (accessed Jan. 16, 2007).

* cited by examiner

43

ANTE

| | |
|---|---|
| ROYAL FLUSH | 1,000 TO 1 |
| STRAIGHT FLUSH | 100 TO 1 |
| FOUR-OF-A-KIND | 30 TO 1 |
| FULL HOUSE | 5 TO 1 |
| FLUSH | 2 TO 1 |
| STRAIGHT | 1 TO 1 |
| OTHER WINNING HANDS | PUSH |

FIG. 1

42

BAD BEAT

PLAYER'S LOSING HAND

| | |
|---|---|
| STRAIGHT FLUSH | 500 TO 1 |
| FOUR-OF-A-KIND | 200 TO 1 |
| FULL HOUSE | 50 TO 1 |
| FLUSH | 30 TO 1 |
| STRAIGHT | 20 TO 1 |
| THREE-OF-A-KIND | 15 TO 1 |
| TWO PAIR | 8 TO 1 |
| PAIR OF JACKS OR BETTER | 3 TO 1 |

FIG. 2

METHODS OF MANAGING PLAY OF WAGERING GAMES AND SYSTEMS FOR MANAGING PLAY OF WAGERING GAMES

BACKGROUND

1. Field

In general, the inventive arrangements relate to card play, and more specifically, to a poker variety thereof.

2. Description of Related Art

For illustrative, exemplary, representative, and non-limiting purposes, one preferred embodiment of the inventive arrangements will be described in terms of live card play at a casino. However, the inventive arrangements are not limited in this regard.

Card games are well known. Many varieties exist, including for one or more of entertainment, leisure, recreation, gaming, gambling, and/or the like. One popular variety is poker, in which players compete against other players and/or a dealer in an attempt to obtain a best hand that outranks other hands according to hand rankings, such as the following ascending hierarchy for a typical five-card poker game:

High Card
One Pair
Two Pair
Three-of-a-Kind
Straight
Flush
Full House
Four-of-a-Kind
Straight Flush
Royal Flush Within this hierarchy, whichever participant holds a highest ranking hand at the end of play wins that particular hand, round, game, match, tournament, and/or the like. Poker is a well-liked and often-played game enjoyed by millions of people around the world, perhaps because it invokes a unique combination of, inter alia, skill, luck, risk-reward strategies, and/or psychology.

Many variations of poker games exist. An inventive variation will now be described.

SUMMARY

In game play, a dealer receives an ante wager from a player seeking to participate in the game. The dealer then deals four cards, all face down, to the player, as well as four cards, all face down, to the dealer. The dealer also deals three community cards, all face down, to a common area. The player discards one of the player's four cards, whereby the player is left with three remaining cards.

Based, at least in part, on the player's assessment of the player's three cards, the player may either i) fold or ii) place a first play wager if the player desires to continue play, the first play wager being equal to one or two or three or four times the ante wager. The dealer then reveals a first community card to the player.

Based, at least in part, on the player's assessment of the player's three cards and/or the first community card, the player may either i) fold or ii) place a second play wager if the player desires to continue play, the second play wager being equal to one or two or three times the ante wager. The dealer then reveals a second community card to the player.

Based, at least in part, on the player's assessment of the player's three cards and/or the first community card and/or the second community card, the player may either i) fold or ii) place a third play wager if the player desires to continue play, the third play wager being equal to one or two times the ante wager. The dealer then reveals a third community and final card to the player.

If the player did not fold, then the dealer reveals the dealer's best five-card poker hand formed from any of the dealer's four cards and three community cards. Likewise, the player reveals the player's best five-card poker hand formed from any of the player's three cards and three community cards. Whichever participant holds a highest ranking hand at the end of play wins. Other rules and/or permutations are implemented as well.

In one embodiment, the inventive arrangements are implemented as a table game for one or more players and a live dealer.

In another or the same embodiment, at least part of the inventive arrangements are implemented as programming instructions at an electronic, or at least partially electronic, table game for one or more players and a live dealer.

In yet other or the same embodiments, at least part of the inventive arrangements are implemented as programming instructions at a video device for one or more players and a virtual dealer.

In yet still other or the same embodiments, at least part of the inventive arrangements are implemented as programming instructions at a gaming device for an individual player.

In further or the same embodiments, at least part of the inventive arrangements are carried out over a communications network.

In additional or the same embodiments, at least part of the inventive arrangements are carried out over a computer network.

BRIEF DESCRIPTION OF SEVERAL VIEWS OF THE DRAWINGS

A clear conception of the advantages and features constituting inventive arrangements, and of various construction and operational aspects of typical mechanisms enabling such arrangements, are readily apparent by referring to the following illustrative, exemplary, representative, and non-limiting figures, which form an integral part of this specification, in which like numerals generally designate the same elements in the several views, and in which:

FIG. 1 illustrates an ante-wager paytable implemented with the inventive arrangements;

FIG. 2 illustrates a side-wager paytable implemented with the inventive arrangements;

DETAILED DESCRIPTION OF PREFERRED EMBODIMENTS

Figure 3:
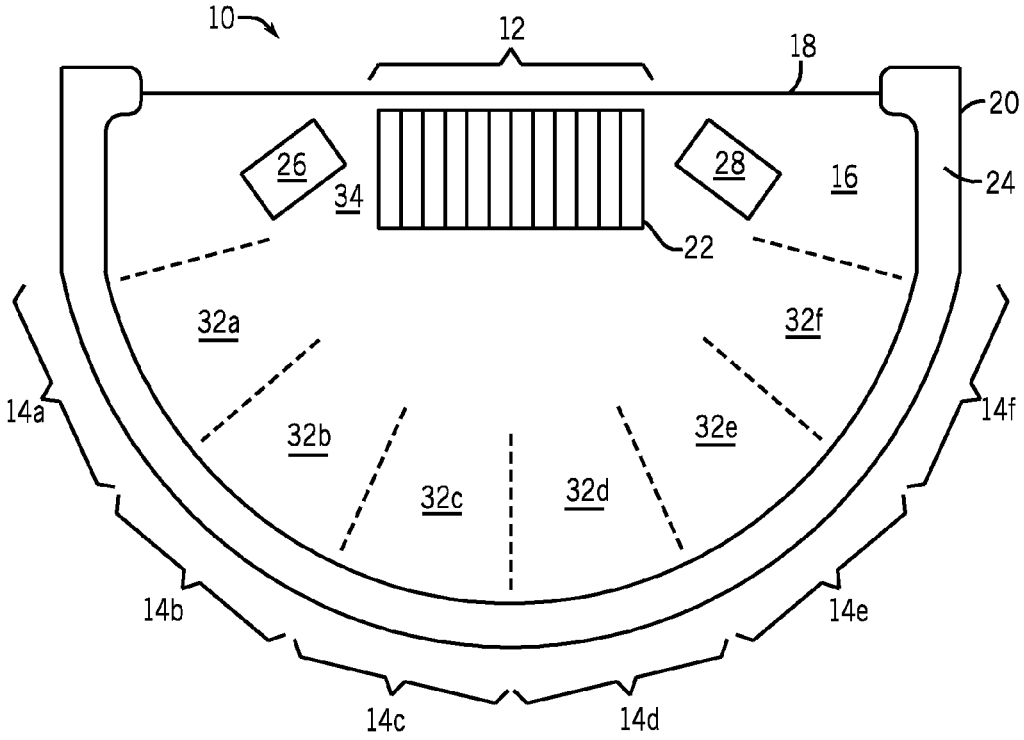
FIG. 3 is a top view of a preferred table game arrangement for implementing the inventive arrangements at a table game for one or more players and a live dealer.
Figure 4:
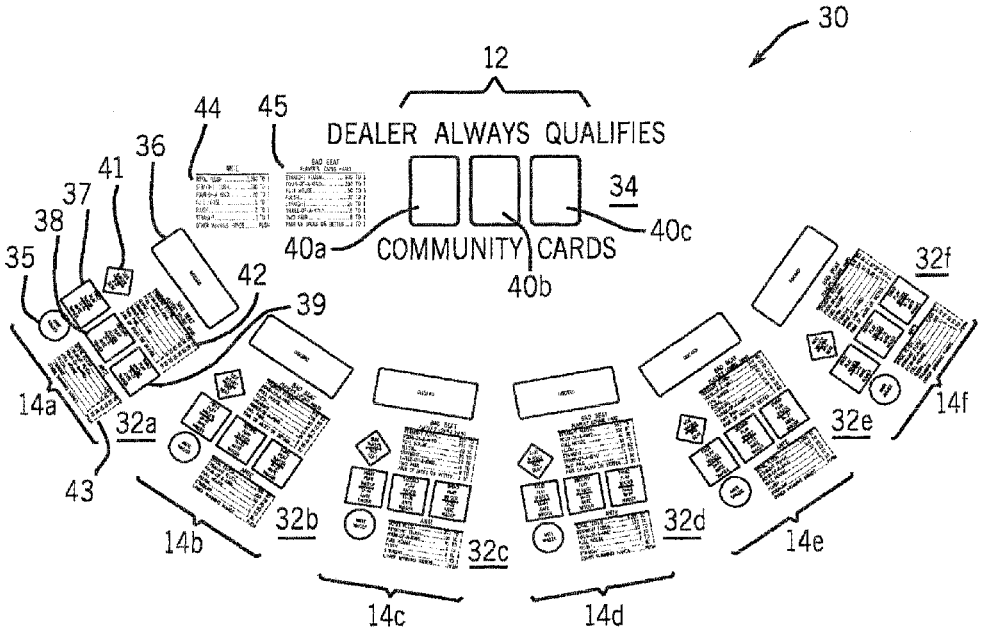
FIG. 4 is a top view of a preferred table game layout for implementing the inventive arrangements at a table game for one or more players and a live dealer.

Referring now to the figures, several preferred embodiments of the inventive arrangements are described in terms of card play at a casino. However, the inventive arrangements are not limited in this regard. For example, while one preferred embodiment provides a set of rules for live game play in a casino context, other contexts are also hereby contemplated and disclosed, including various other applications and/or executions of the rules of play.

As a preliminary matter, a complete set of cards is often referred to as a deck, or pack, of cards, and a subset thereof, particularly as held by a player during game play, is often referred to as a hand. In general, one face of each card usually carries card markings (e.g., ranks and suits) that distinguish it from other cards in the deck, while a back thereof is usually identical for all of the cards in the deck (e.g., often artistically styled with one or more colors and/or designs).

The inventive arrangements preferably use one standardized 52-card poker deck. In alternative embodiments, multiple decks are used. In the same or other embodiments, wild cards, jokers, and/or the like are also used. Preferably, the cards are shuffled *a priori*, preferably by a shuffler or shuffling apparatus. Ideally, this randomizes all of the cards before game play begins, thereby generating a random permutation of card orderings for non-biased card play. In one embodiment, the cards are physical playing cards. In other alternative embodiments, the cards are virtual playing cards.

Detailed rules of play will now be described.

In order to participate in the game, a player offers an ante wager to a dealer, which is a set amount tendered by every player prior to cards being dealt. Once a player has offered an ante wager to the dealer and the dealer has received and accepted same, card play begins, notably with the dealer dealing four cards, all face down, to the player. Likewise, the dealer deals four cards, all face down, to the dealer as well. The dealer also deals three community cards, all face down, to a common area.

Preferably, the cards are dealt first to the player and then to the dealer and then to the common area; or alternatively, first to the player and then to the common area and then to the dealer; or alternatively, first to the dealer and then to the player and then to the common area; or alternatively, first to the dealer and then to the common area and then to the player; or alternatively, first to the common area and then to the player and then to the dealer; or alternatively, first to the common area and then to the dealer and then to the player; and/or in an otherwise alternating fashion between the player, dealer, and common area.

After the cards are dealt, the player discards one of the player's four cards, whereby the player is left with three remaining cards. The dealer maintains the dealer's four cards.

The player has a choice to make. Based, at least in part, on the player's individual assessment of the player's hand and/or the dealer's likely final hand, the player may choose to fold the player's hand, in which case the player's ante wager is forfeited and surrendered to the dealer and play discontinues for that player for that match-up. The player's decision is personal to that player. It may be based on subjective factors, objective factors, both, or other. The player's goal is to beat the dealer's hand according to which hand will likely have a highest hand ranking according to standard five-card poker hand rankings. Alternatively, based, again at least in part, on the player's individual assessment of the player's hand and/or the dealer's likely final hand, the player may instead choose to continue play, in which case the player makes an additional wager, called a play wager, and in this case, a first play wager, in order to be able to stay in the game and continue to participate and play. Preferably, the player's first play wager is based on the player's ante wager, particularly in an amount of one or two or three or four times the ante wager. As such, the amount of the player's first play wager is the player's choice, in one of these 1×, 2×, 3×, or 4× amounts.

The dealer then reveals the first community card.

The player has another choice to make. Based, at least in part, on the player's individual assessment of the player's hand and/or the dealer's likely final hand, the player may choose to fold the player's hand, in which case the player's ante wager and first play wager are forfeited and surrendered to the dealer and play discontinues for that player for that match-up. The player's decision is personal to that player. It may be based on subjective factors, objective factors, both, or other. The player's goal is to beat the dealer's hand according to which hand will likely have a highest hand ranking according to standard five-card poker hand rankings. Alternatively, based, again at least in part, on the player's individual assessment of the player's hand and/or the dealer's likely final hand, the player may instead choose to continue play, in which case the player makes an additional wager, in this case, a second play wager, in order to be able to stay in the game and continue to participate and play. Preferably, the player's second play wager is based on the player's ante wager, particularly in an amount of one or two or three times the ante wager. As such, the amount of the player's second play wager is the player's choice, in one of these 1×, 2×, or 3× amounts.

The dealer then reveals the second community card.

Now then, the player has another choice to make. Based, at least in part, on the player's individual assessment of the player's hand and/or the dealer's likely final hand, the player may choose to fold the player's hand, in which case the player's ante wager and first play wager and second play wager are forfeited and surrendered to the dealer and play discontinues for that player for that match-up. The player's decision is personal to that player. It may be based on subjective factors, objective factors, both, or other. The player's goal is to beat the dealer's hand according to which hand will likely have a highest hand ranking according to standard five-card poker hand rankings. Alternatively, based, again at least in part, on the player's individual assessment of the player's hand and/or the dealer's likely final hand, the player may instead choose to continue play, in which case the player makes an additional wager, in this case, a third play wager, in order to be able to stay in the game and continue to participate and play. Preferably, the player's third play wager is based on the player's ante wager, particularly in an amount of one or two times the ante wager. As such, the amount of the player's third play wager is the player's choice, in one of these 1× or 2× amounts.

All play wagers have now been placed. More specifically, the player has now placed all of the player's desired play wagers.

The dealer then reveals the third—and final—community card.

If, and after, the player placed the first play wager and second play wager and third play wager and did not fold, both the dealer and player make their best five-card poker hands from their respective hands. More specifically, the dealer makes the dealer's best five-card poker hand formed from the dealer's four cards and the three community cards. Likewise, the player makes the player's best five-card poker hand formed from the player's three cards and the three community cards.

More specifically, the dealer's best five-card hand includes as many of the community cards as the dealer desires in order to make the dealer's best five-card poker hand. For example, since the dealer needs five cards to make the dealer's best five-card poker hand, the dealer's hand includes one of the following: i) four of the dealer's cards and one community card; ii) three of the dealer's cards and two community cards; or iii) two of the dealer's cards and three community cards—thereby forming the dealer's best five-card poker hand.

Likewise, the player's best five-card hand includes as many of the community cards as the player desires in order to make the player's best five-card poker hand. For example, since the player needs five cards to make the player's best five-card poker hand, the player's hand includes one of the following: i) three of the player's cards and two community cards; or ii) two of the player's cards and three community cards—thereby forming the player's best five-card poker hand.

In this dealer versus player match-up, whichever holds a highest ranking hand at the end of play wins. In other words, if the dealer's best five-card poker hand outranks the player's best five-card poker hand according to standard five-card poker hand rankings, then the dealer wins. If the dealer wins, then the dealer preferably keeps the player's ante wager and the player's play wagers. Alternatively, if the player's best five-card poker hand outranks the dealer's best five-card poker hand according to standard five-card poker hand rankings, then the player wins. If the player wins, then the ante wager is paid according to a paytable, such as that depicted in FIG. 1. In a preferred paytable, the player must have a straight or better to receive a pay out on the ante wager from the paytable. Preferably, the player must beat the dealer in order for the ante wager to pay out according to the paytable. In addition, if the player wins, then the player receives even money on all of the player's play wagers.

Other than folding, the player faces three play wagering choices—namely, the first play wager, second play wager, and third play wager. The amount wagered during each play wager opportunity is a multiple of the ante wager, each with a successively decreasing maximum bet as additional community cards are exposed. However, each play wager is otherwise independent of the other play wagers. Accordingly, if the player did not fold and placed all three play wagers in order to continue play, the following 24 (twenty-four) possible combinations result, yielding winning payouts on the play wagers to the player from a minimum of three times the ante wager to a maximum of nine times the ante wager:

| First Play Wager [1× or 2× or 3× or 4× wager] | Second Play Wager [1× or 2× or 3× ante wager] | Third Play Wager [1× or 2× ante wager] | Total Winning Payout |
|---|---|---|---|
| 1× ante wager | 1× ante wager | 1× ante wager | 3× ante wager |
| | | 2× ante wager | 4× ante wager |
| | 2× ante wager | 1× ante wager | 4× ante wager |
| | | 2× ante wager | 5× ante wager |
| | 3× ante wager | 1× ante wager | 5× ante wager |
| | | 2× ante wager | 6× ante wager |
| 2× ante wager | 1× ante wager | 1× ante wager | 4× ante wager |
| | | 2× ante wager | 5× ante wager |
| | 2× ante wager | 1× ante wager | 5× ante wager |
| | | 2× ante wager | 6× ante wager |
| | 3× ante wager | 1× ante wager | 6× ante wager |
| | | 2× ante wager | 7× ante wager |
| 3× ante wager | 1× ante wager | 1× ante wager | 5× ante wager |
| | | 2× ante wager | 6× ante wager |
| | 2× ante wager | 1× ante wager | 6× ante wager |
| | | 2× ante wager | 7× ante wager |
| | 3× ante wager | 1× ante wager | 7× ante wager |
| | | 2× ante wager | 8× ante wager |
| 4× ante wager | 1× ante wager | 1× ante wager | 6× ante wager |
| | | 2× ante wager | 7× ante wager |
| | 2× ante wager | 1× ante wager | 7× ante wager |
| | | 2× ante wager | 8× ante wager |
| | 3× ante wager | 1× ante wager | 8× ante wager |
| | | 2× ante wager | 9× ante wager |

In the same and/or other alternative embodiments, if neither the dealer's best five-card poker hand outranks the player's best five-card poker hand or the player's best five-card poker hand outranks the dealer's best five-card poker hand (in other words, the hands tie) then the dealer preferably keeps the player's ante wager and the player's play wagers.

In the same and/or other alternative embodiments, an optional or mandatory side wager is also offered to the player. More specifically, the player tenders, and the dealer accepts, a side wager from the player, preferably at the same time, or shortly after, the ante wager is received to initiate play. Preferably, the side wager is tendered before any cards are dealt, including dealing any and all cards to the player and to the dealer. Preferably, the side wager is paid according to a paytable, such as that depicted in FIG. 2, and it is paid only if the dealer wins and the player loses. In a preferred paytable, the player must have a pair of jacks or better to receive a pay out on the side wager from the paytable. Preferably, if neither the dealer's best five-card poker hand outranks the player's best five-card poker hand or the player's best five-card poker hand outranks the dealer's best five-card poker hand (in other words, the hands tie) then the dealer returns the player's side wager to the player.

The rules of game play have been described according to preferred embodiments. In various embodiments, these rules are taught to a dealer administering the game and/or programmed into a computing device executing same. In the same and/or other alternative embodiments, this set of instructions for game play is preferably implemented and/or executed as one or more of at least the following:

a table game for one or more players and a live dealer;

programming instructions at an electronic, or at least partially electronic, table game for one or more players and a live dealer;

programming instructions implemented at a video device for one or more players and a virtual dealer;

programming instructions implemented at a gaming device for an individual player;

programming instructions carried out over a communications network; and/or programming instructions carried out over a computer network.

Each of these game play implementations, and more, is contemplated by, and configurable according to, the inventive arrangements.

In summary fashion, each will also now be described.

Referring now to FIG. 3, the inventive arrangements are, in one embodiment, preferably implemented as a table game, such as, for example, in a casino, hall, casino hall, hotel, hotel room, casino hotel, race track, racino, gambling hall, gaming hall, parlor, card room, lounge, lobby, studio, conference facility, convention facility, auditorium, gymnasium, school, store, convenience store, grocery store, gas station, mall, strip mall, midway, cruise ship, floating vessel, flying vessel, and/or the like (none shown), using physical playing cards (not shown). More specifically, the game method is implemented on a physical table 10, in which a dealer position 12 for a dealer (dealer not shown) is in generally opposite relation to one or more player positions 14 for players (players not shown). In one preferred embodiment, six player positions 14*a*-14*f* are provided.

More specifically, and as is typical of structural components of gaming tables in the industry, at least a top surface 16 of the table 10 is, in a preferred form, generally semi-circular in nature and/or shape, with the dealer position 12 being generally proximate to, and central of, a generally straight edge 18 thereof, and the player positions 14 being generally disposed in side-by-side arrangements proximate to, and adjacent of, a generally arcuate edge 20 thereof. Preferably, the top surface 16 is generally horizontal with respect to a floor (not shown) on which the table 10 rests.

As may vary with a desired table configuration, the dealer position 12 is partly or wholly padded (none shown) along the straight edge 18 of the top surface 16 of the table 10. Preferably, a chip rack 22 is also supported by the top surface 16 of the table 10 and proximate to the dealer position 12, particularly for holding and/or storing physical poker chips (not shown) and/or the like during game play. Commonly, a player armrest and/or perimeter pad 24 extends about the arcuate edge 20 of the top surface 16 of the table 10, generally along the player positions 14 and outwardly facing the players. Particularly to initiate and during game play, one or more players generally sit or stand along the arcuate edge 20 of the top surface 16 of the table 10, thereby occupying a player position 14 and engaging the dealer from the dealer position 12.

In addition, a preferred table 10 is also configured to accommodate one or more of a card shuffler 26 and/or a card shoe 28. Both are also representatively depicted. For example, in the same and/or alternative embodiments, both are located on, adjacent to, and/or otherwise proximate to the top surface 16 of the table 10, particularly located to facilitate game play from the dealer position 12. In various embodiments, the card shuffler 26 is a batch shuffler, continuous shuffler, and/or other, including various types of physical and/or mechanical shufflers used to randomize cards and/or card orderings. In various embodiments, the card shuffler 26 is single deck and/or multiple deck shuffler. In various embodiments, the card shuffler 26 and card shoe 28 are one-in-the-same or different devices. In various embodiments, one or both include one or more of card reading capabilities, card recognition capabilities, card counting capabilities, card recalling capabilities, hand-forming capabilities, and/or the like. Other variations are also contemplated. For example, in a preferred virtual embodiment (described in additional detail below), the card shuffler 26 is preferably implemented as a random number generator, while the inventive arrangements are, in various other embodiments, also implemented by manually shuffling and/or dealing playing cards by hand as well.

Referring to FIGS. 1-6, one preferred way to implement the inventive methods on the table 10 is to include a layout 30 on the top surface 16 of the table 10. More specifically, the layout 30 preferably delineates one or more of the player positions 14 (e.g., 14*a*-14*f*), each of which includes a respective player area 32 (e.g., 32*a*-32*f*) for each player. In summary fashion, each player area 32 provides and/or defines an individual playing space for each player during game play. This layout 30 also delineates the dealer position 12, including a dealer area 34 for the dealer. As such, the layout 30 is configured to facilitate game play on the table 10. For example, when played with physical poker chips, a first player spot 35 is preferably provided for each player to provide that player's ante wager. A second player spot 36 is preferably provided for each player to discard one of the player's four cards, whereby the player is left with the three remaining cards.

A third player spot 37 is preferably provided for each player to provide that player's first play wager, assuming, that is, that the player has decided to continue play after that player has assessed the player's hand and/or the dealer's likely hand after all cards have been dealt and the player has discarded the player's one card. Preferably, additional gaming instructions are also communicated at, within, and/or proximate to, the player area 32, such as, for example, informing and/or reminding the player that the player's first play wager is preferably 1×-4× the player's ante wager. Preferably, such additional gaming instructions are provided at, within, and/or proximate to the third player spot 37.

A fourth player spot 38 is preferably provided for each player to provide that player's second play wager, assuming, that is, that the player has decided to continue play after that player has assessed the player's hand and/or the dealer's likely hand after all cards have been dealt and the first community card has been revealed. Preferably, additional gaming instructions are also communicated at, within, and/or proximate to, the player area 32, such as, for example, informing and/or reminding the player that the player's second play wager is preferably 1×-3× the player's ante wager. Preferably, such additional gaming instructions are provided at, within, and/or proximate to the fourth player spot 38.

A fifth player spot 39 is preferably provided for each player to provide that player's third play wager, assuming, that is, that the player has decided to continue play after that player has assessed the player's hand and/or the dealer's likely hand after all cards have been dealt and the first community card and second community card have been revealed. Preferably, additional gaming instructions are also communicated at, within, and/or proximate to, the player area 32, such as, for example, informing and/or reminding the player that the player's third play wager is preferably 1×-2× the player's ante wager. Preferably, such additional gaming instructions are provided at, within, and/or proximate to the fifth player spot 39.

Preferably, three dealer card locations 40*a*-40*c* are also provided on the layout 30, which provide individual locations for the community cards within the dealer area 34 and which become exposed face up during game play.

When the gaming method is offered with an additional optional or mandatory side wager from the player, a sixth player spot 41 is also preferably provided for each player to provide that player's side wager. Preferably, additional gaming instructions are also provided at, within, and/or proximate to the sixth player spot 41, such as, for example, informing and/or reminding the player of a side-wager paytable 42, such as that depicted in FIG. 2. Likewise, the layout 30 also preferably conveys the ante-wager paytable 43, such as that depicted in FIG. 1.

Figure 5:
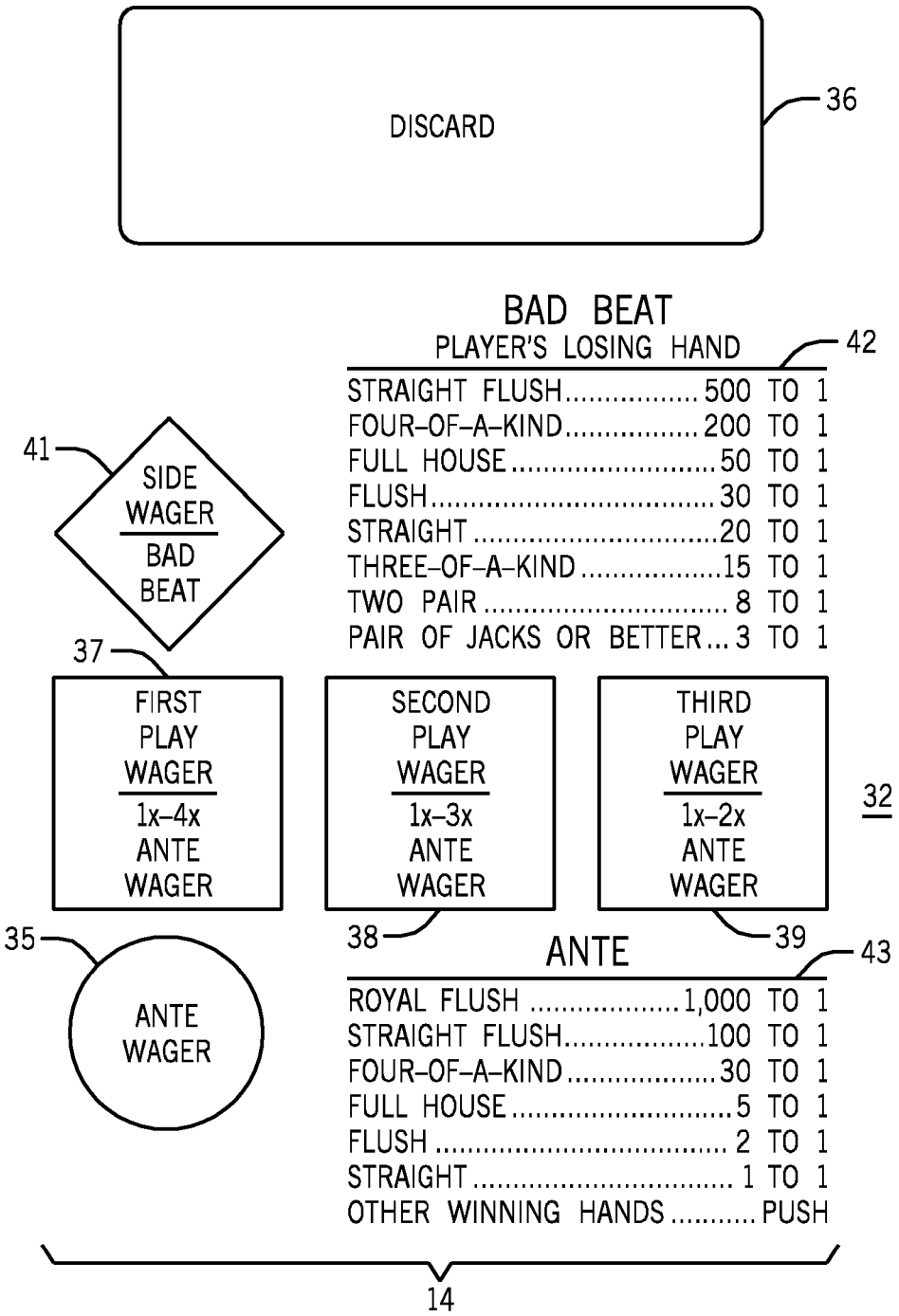
FIG. 5 illustrates a close-up of a player position from the table game layout of FIG. 4.

In representative fashion, FIG. 5 individually depicts a single player position 14 from the layout 30 on the top surface 16 of the table 10 (FIG. 2), including the respective player area 32 for the player and also including i) the first player spot 35 for the player to place the player's ante wager to begin game play; ii) the second player spot 36 for each player to discard one of the player's four cards; iii) the third player spot 37 for each player to place that player's first play wager; iv) the fourth player spot 38 for each player to place that player's second play wager; v) the fifth player spot 39 for each player to place that player's third play wager; vi) the sixth player spot 41 for each player to place that player's side wager, if any; vii) the side-wager paytable 42; and/or viii) the ante-wager paytable 43.

As thusly described, the inventive arrangements describe a method of card play on a physical table 10. Commonly, ante wagers, play wagers, and/or side wagers are placed using physical poker chips, which the dealer preferably banks through the chip rack 22. In one preferred embodiment, the player tenders such wagers through one or more of the first player spot 35, third player spot 37, fourth player spot 38, fifth player spot 39, and sixth player spot 41, namely by placing the physical poker chips thereupon the top surface 16 of the table 10.

In another alternative embodiment, the player tenders such wagers electronically, including at a chipless table 10'. More specifically, as will now be elaborated upon, wagering at a chipless table 10' is preferably based on a player's credit instead of a player's physical poker chips.

In the industry, game profitability is influenced by the speed at which dealers and players play games. Gaming platforms are thus commonly designed to address and/or accommodate at least some or all of the following: increasing the speed of play, including the speed of wagering; decreasing and/or altogether eliminating pay out errors; facilitating cash-ins and cash-outs; preventing cheating; and/or preventing dealers from colluding with players. A chipless table 10' address such concerns.

Figure 6:
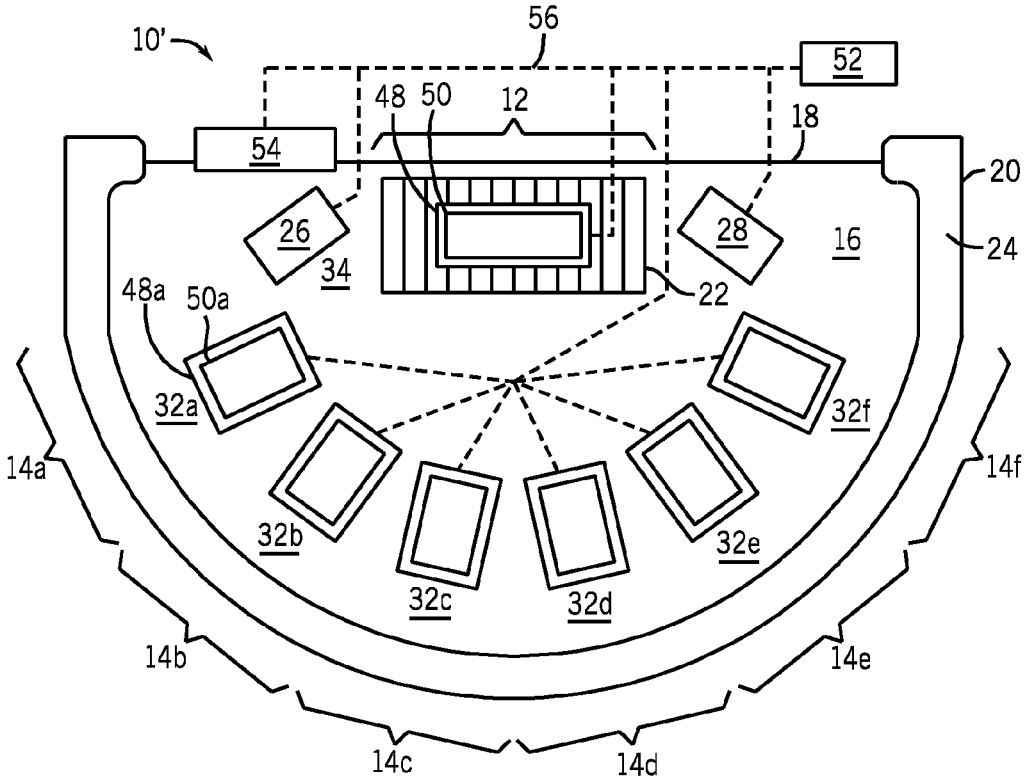
FIG. 6 is a top view of a preferred table game arrangement for implementing the inventive arrangements at an electronic, or at least partially electronic, table game for one or more players and a live dealer.

More specifically, and referring now to FIG. 6, the top surface 16 of the chipless table 10' still preferably supports a chip rack 22, but namely to facilitate players cashing in and cashing out of game play. As mentioned, wagering at the chipless table 10' is preferably based on the player's credit instead of the player's physical poker chips. Commonly, credit is first registered when the player approaches the chipless table 10' and desires to play, often by exchanging physical poker chips and/or tickets, tokens, coins, cash, currency, credits, cards, player accounts, mercantile exchange, and/or the like for an electronic credit. Preferably, the dealer banks the player's physical poker chips (if provided) at or in the chip rack 22 (or other). In any event, when the player discontinues play, the process is reversed, namely, the electronic credit, if any, is exchanged for poker chips (if provided) from the chip rack 22 (or other). In the interim, however, the player's collateral is preferably wagered, bartered, tracked, and/or monitored electronically.

Even more specifically, the top surface 16 of the chipless table 10' preferably supports a display/input interface 48*a* at each player area 32 for each player position 14. Preferably, the player's display/input interface 48*a* is flush mounted with the top surface 16 of the table 10.

Likewise, the top surface 16 of the chipless table 10' also preferably supports a display/input interface 48 at the dealer area 34 for the dealer position 12. Preferably, the dealer's display/input interface 48 is intermediate the chip rack 22.

Preferably, common display/input interfaces 48 include one or more of the following in various embodiments: analog screens, cathode ray tube (CRT) screens, digital screens, light-emitting diode (LED) screens, liquid-crystal diode (LCD) screens, plasma screens, and/or the like, as well as one or more of single screens, dual screens, triple screens, split screens, segment screens, picture-in-picture screens, holographic screens, virtual screens, two-dimensional screens, three-dimensional screens, and/or the like.

Preferably, each display/input interface 48*a* also includes a data entry input 50*a*, such as a touch-screen data entry surface. In various embodiments, they react to one or more of pressure, heat, moisture, and/or other conductivity measures, and/or the like.

The display/input interface 48 and data entry input 50 enable the player and/or dealer to participate in the game by communicating at least some instructions electronically through the display/input interface 48 and/or data entry input 50. For example, when a player approaches the chipless table 10' and desires to play, the player exchanges physical poker chips (or other) for an electronic credit, executed through the display/input interface 48 and/or data entry input 50. The underlying card game then proceeds according to the previously-described rules of play, with game play decisions and/or wagering continuing through the display/input interface 48 and/or data entry input 50—e.g., placing and receiving ante wagers, play wagers, and/or side wagers; closing wagers; deciding whether and when to fold; providing visual communications and/or instructions to the player and/or dealer; concluding play; indicating game outcome information; resolving wagers; concluding play; indicating trending information; etc. And preferably, wagers are resolved automatically by adding and/or subtracting, as appropriate, to corresponding player accounts, again preferably through the display/input interface 48 and/or data entry input 50. Finally, when the player discontinues play, the player exchanges the electronic credit, if any, for physical poker chips (or other), again executed through the display/input interface 48 and/or data entry input 50.

In the same and/or other alternative embodiments, physical card play through the card shuffler 26 and/or card shoe 28 on the chipless table 10' is additionally and/or alternatively replaced with virtual card play, again through the display/input interface 48 and/or data entry input 50.

Preferably, the display/input interface 48 and data entry input 50 are controlled by a control processor 52, preferably located internally within, or otherwise proximate to, the chipless table 10'. In alternative embodiments, the control processor 52 is located elsewhere in a gaming pit and/or location remote from the gaming pit, as needed and/or desired in a particular implementation. In any event, the control processor 52 is programmed, by known techniques, to implement the previously-described rules of play at the chipless table 10'. As such, the control processor 52 interacts and communicates with the display/input interface 48 and data entry input 50, wherein up-dated game and/or wagering information is communicated to the player and dealer as game play advances, particularly at the player area 32 and dealer area 34 of the chipless table 10'.

Preferably, each display/input interface 48 contains its own control processor (not shown) to control same, particularly in communication with the control processor 52. For example, the former preferably administers graphics for display on the display/input interface 48, while the latter preferably administers other game events and/or happenings. In various embodiments, relations therebetween are preferably peer-to-peer, master-slave, client-server, thin-client systems, blended and/or hybrid systems, and/or the like.

Preferably, the control processor 52 also interacts and communicates with one or both of the card shuffler 26 and/or card shoe 28.

Preferably, the control processor 52 also interacts and communicates with a game display 54, which communicates relevant game events and/or happenings, e.g., a game name;

rules of play; player status; dealer status; game status; win and loss information; trending information; the side-wager paytable 42; the ante-wager paytable 43; hand counts; time of day; etc. In different embodiments, the game display 54 is preferably a one-sided or two-sided display, displaying the same or different information on opposing sides thereof. Preferably, the game display 54 is pole-mounted above the top surface 16 of the chipless table 10' for ease of viewing.

Preferably, one or more of the card shuffler 26, card shoe 28, display/input interface 48, data entry input 50, control processor 52, and/or game display 54 communicate through a wired, partially wired, and/or wireless communications network 56. Preferably, communication is not limited to electric and/or electronic communications over the communications network 56, but, in various embodiments, it also extends to one or more of optical, audio, and/or magnetic communications networks 56 as well, and/or the like. In a preferred layered construction embodiment, at least part or all of the communications network 56 is embedded on or near the top surface 16 of the chipless table 10', such as underneath the layout 30.

Figure 7:
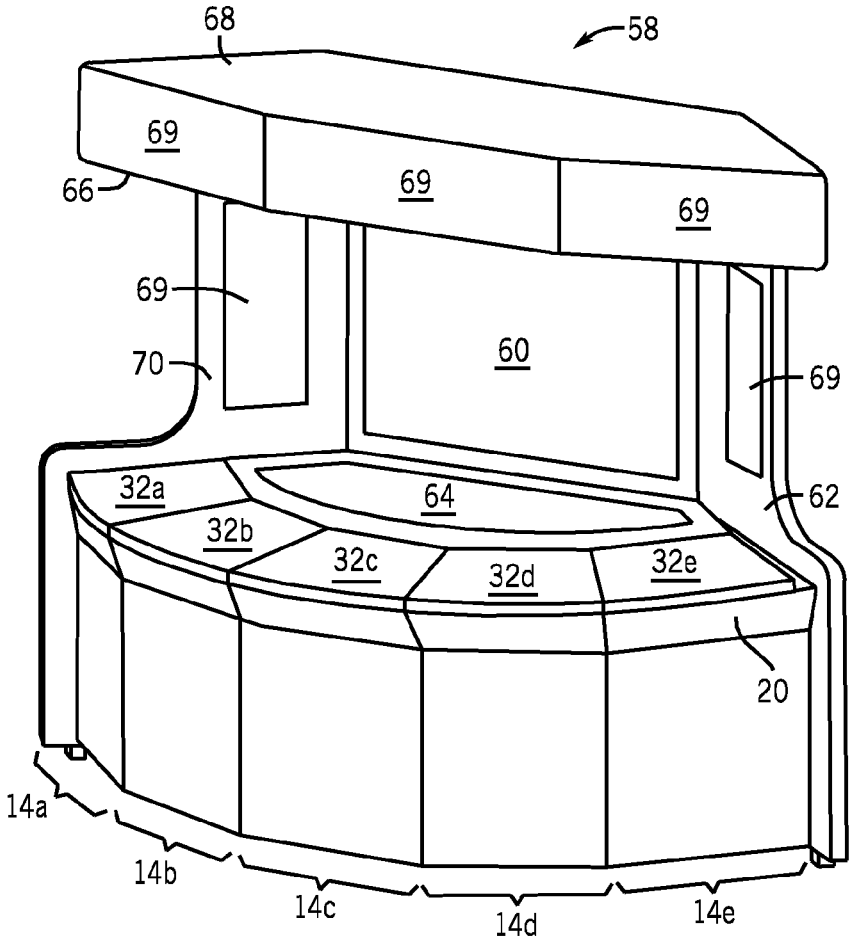
FIG. 7 is a perspective view of a video machine for implementing the inventive arrangements at a video device for one or more players and a virtual dealer.

Referring now to FIG. 7, the inventive arrangements are also carried out, in various embodiments, at an electronic, or at least partially electronic, table game for one or more players and a virtual dealer. More specifically, the player positions 14 (e.g., 14*a*-14*e*) are arranged in a bank about an arcuate edge 20 of a video device 58. In essence, at least portions of the video device 58 serve as the table 10, 10' from the previous embodiments, in which the player positions 14 include the player area 32 (e.g., 32*a*-32*e*)for interacting with the video device 58. The functionality of the display/input interface 48 and data entry input 50 is again brought to the player area 32, preferably by the control processor 52, preferably located internally within, or otherwise proximate to, the video device 58. As previously described, the control processor 52 is again programmed, by known techniques, to implement the previously-described rules of play at the video device 58. As such, the control processor 52 interacts and communicates with the display/input interface 48 and data entry input 50, wherein up-dated game and/or wagering information is communicated to the player as game play advances, particularly at the player area 32 of the video device 58.

Whereas the previously-described table 10, 10' preferably included live card play with a live dealer, the video device 58 instead includes a virtual dealer depicted on a dealer screen 60 (dealer not shown), preferably positioned for forward viewing by at least a player in a player position 14. Preferably, the dealer screen 60 displays a video simulation of the dealer, i.e., a virtual dealer, for interacting with the video device 58, preferably through processing one or more stored programs to implement the previously described rules of play at the video device 58. Preferably, the dealer screen 60 is carried by a generally vertically depending cabinet 62 of the video device 58.

Preferably, the video device 58 also includes a card screen 64, in which at least one or more of the dealer's cards and/or player's cards are displayed as dealt by the virtual dealer. For example, in a preferred embodiment, the card screen 64 preferably displays the dealer's cards, preferably including the dealer card locations 40*a*-40*c* (FIG. 4) from the dealer area 34 of the table 10 (FIG. 3) at the video device 58.

Preferably, the player area 32 is configured for wagering and game play interactions with the video device 58 and/or virtual dealer. To further enhance the experience, additional decorative lights (not shown) are provided in various embodiments, as are speakers (not shown) for transmitting and/or receiving sounds during game play, the latter preferably on an underside surface 66, for example, of a generally horizontally depending top 68 of the cabinet 62 of the video device 58 generally extending toward the player positions 14. Preferably, banners 69 communicate rules of play and/or the like, preferably along one or more walls 70 or the like of the cabinet 62 of the video device 58. Accordingly, game play is preferably accommodated without involving physical playing cards, poker chips, and/or live personnel. The action is instead simulated by the control processor 52 interacting with and controlling the video device 58 (FIG. 6).

Figure 8:
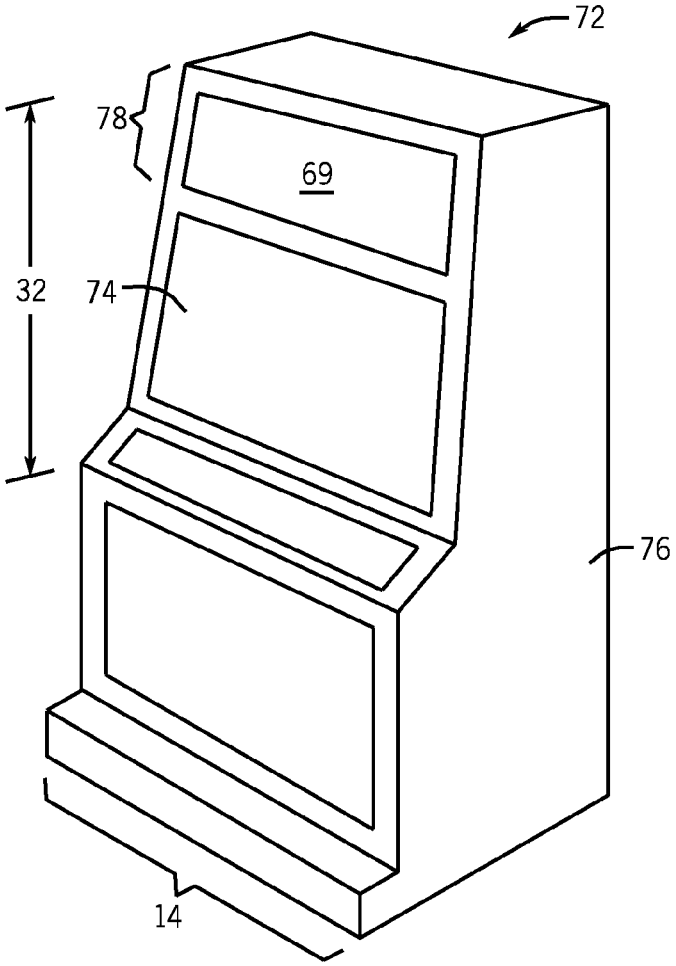
FIG. 8 is a perspective view of a video machine for implementing the inventive arrangements at a gaming device for an individual player.

Referring now to FIG. 8, the inventive arrangements are also carried out as a video poker game for an individual player. More specifically, a player position 14 is arranged about a gaming device 72 configured for individual play. Again, the player position 14 includes a player area 32 for interacting with the gaming device 72. The functionality of the display/input interface 48 and data entry input 50 (FIG. 6) is again brought to the player area 32, again preferably by the control processor 52, (FIG. 6), preferably located internally within, or otherwise proximate to, the gaming device 72. As previously described, the control processor 52 is again programmed, by known techniques, to implement the previously described rules of play at the gaming device 72. As such, the control processor 52 again interacts and communicates with the display/input interface 48 and data entry input 50, wherein up-dated game and/or wagering information is communicated to the player as game play advances, particularly at the player area 32 of the gaming device 72.

The gaming device 72 preferably includes a gaming screen 74, preferably positioned for forward viewing by at least a player in a player position 14. Preferably, the gaming screen 74 displays indicia for interacting with the gaming device 72, preferably through processing one or more stored programs to implement the previously described rules of play at the gaming device 72. Preferably, the gaming screen 74 is carried by a generally vertically depending cabinet 76 of the gaming device 72.

Preferably, the player area 32 is configured for wagering and game play interactions with the gaming device 72. To further enhance the experience, additional decorative lights (not shown) are provided in various embodiments, as are speakers (not shown) for transmitting and/or receiving sounds during game play. Preferably, banners 69 communicate rules of play and/or the like, preferably along a top portion 78 or the like of the cabinet 76 of the gaming device 72. Accordingly, game play is accommodated without involving physical playing cards, poker chips, and/or live personnel. The action is instead simulated by the control processor 52 interacting with and controlling the gaming device 72.

While the gaming device 72 is preferably carried out as a video poker game for an individual player, the gaming device 72 is, in various embodiments, also linked and/or connected to one or more additional gaming devices 72 for enhanced play, such as enabling collective and/or progressive jackpots therebetween. In various embodiments, such multiple gaming devices 72 are located in a same or different location(s).

For at least any or all of the above, including, for example, at least the card shuffler 26, card shoe 28, display/input interface 48, data entry input 50, control processor 52, game display 54, communications network 56, video device 58, dealer screen 60, card screen 64, gaming device 72, gaming screen 74, and/or the like, standard protocols known in the art are preferred, including for software, hardware, firmware, communicationware, cloudware, and/or the like, and/or in various combinations thereof, including any computer languages, programs, operating systems, memory storage devices, data processors, and/or network communication devices that readily enable access to the inventive arrangements, particularly as a chosen matter of suitable design choice by those skilled in such arts. As one such example, memory storage devices store programs and/or instructions, executable by the control processor 52, to control the applicable gaming platforms, and control processer functionality is implemented in one or more control processors 52 acting individually and/or collectively across the gaming platforms.

More specifically, when the inventive arrangements are implemented on a table 10, the dealer position 12 is in generally opposite relation to the one or more player positions 14. On the other hand, when the inventive arrangements are implemented on a video device 58, the functionality of the dealer position 12 is carried out by the control processor 52 acting in conjunction with the video device 58. Likewise, when the inventive arrangements are implemented on a gaming device 72, the functionality of the dealer position 12 is carried out by the control processor 52 acting in conjunction with the gaming device 72. In these instances, the functionality of game play interaction between the dealer (live or control processor based) and player is relatively proximate. On the other hand, in other alternative embodiments, the functionality of game play interaction between the dealer (specifically, control processor based) and player is relatively distant.

Figure 9:
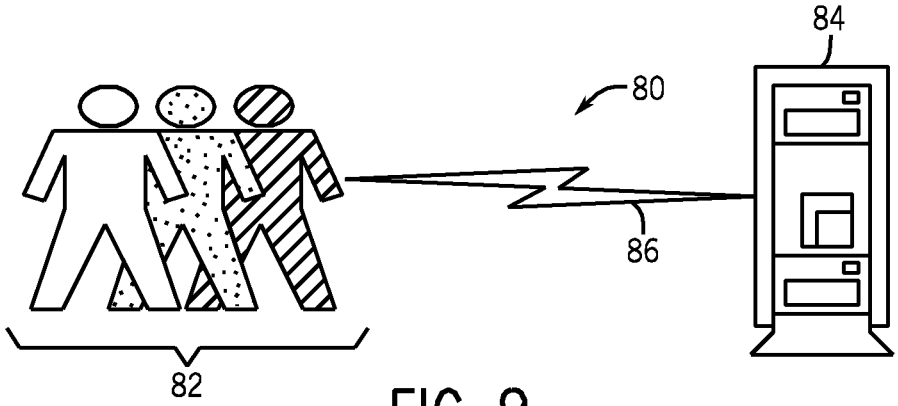
FIG. 9 is a simplified schematic view of a gaming network in which preferred embodiments of the inventive arrangements are carried out over a computer network.

More specifically, and referring now to FIG. 9, a simplified schematic view of a gaming network 80 is depicted in which preferred embodiments of the inventive arrangements are practiced. More specifically, players 82 interact with a computer system 84 through a computer network 86. The players 82 and computer system 84 are physically remote from one another, operatively connected through the computer network 86.

Figure 10:
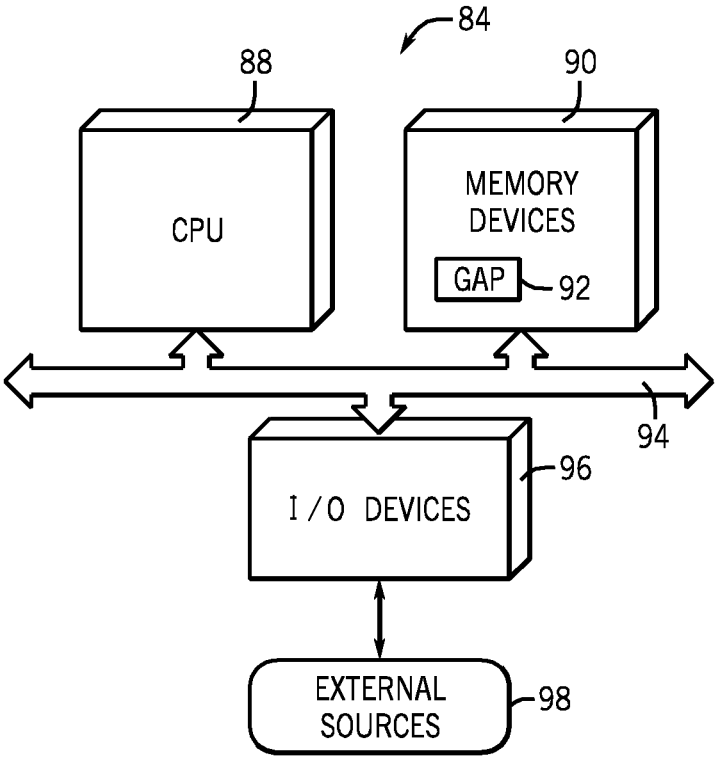
FIG. 10 is a simplified schematic view of the computer system of FIG. 9.

Referring now even more specifically to FIG. 10, the inventive arrangements are preferably implemented on a computer system 84 comprising a central processing unit (CPU) 88 and one or more memory devices 90. Typically, the memory devices 90 include volatile memory (not shown), such as random access memory (RAM), and non-volatile memory (not shown), such as a hard-disk drive or other fixed-storage memory device. The non-volatile memory, which preferably includes read-only memory (ROM), stores therein an operating system (not shown) and one or more application programs, such as a gaming application program (GAP) 92 that enables the inventive arrangements. In alternative embodiments, one or more application programs, including the GAP 92, is stored in a removable memory device (not shown), such as, for example, a floppy disk, optical disc for use, for example, with a CD-ROM, and/or other. In either event, the CPU 88 and memory devices 90 are suitable devices known to those skilled in the art, wherein, for example, the operating system is conventionally loaded from the non-volatile memory into the volatile memory during bootstrapping of the computer system 84 and then executed. Subsequently, the operating system then conventionally loads the GAP 92 from the non-volatile memory into the volatile memory for execution. Upon the loading thereof, the CPU 88 then executes the GAP 92. More specifically, the CPU 88 executes one or more programmed code sections that comprise the GAP 92 in order to perform various operations according to the inventive arrangements. Each programmed code section thus includes instructions that are executed by the CPU 88. As such, the inventive arrangements of the GAP 92 are carried out by the computer system 84.

In operation of the preferred embodiment shown in FIG. 10, the CPU 88 and memory devices 90 communicate through a conventional bus 94, which additionally interfaces with one or more input/output ("I/O") devices 96 also operatively connected thereto. The I/O devices 96 allow the players 82 (FIG. 9) to communicate with the GAP 92 of the computer system 84, such as, for example, through one or more external sources 98 operating over the computer network 86. Accordingly, for example, the computer network 86 enables game play over, for example, the Internet (or other) and/or at, or on, one or more of the following external sources 98: computers, personal computers, networked computers, desktop computers, laptops, notebooks, netbooks, tablets, tablet computers, pads, pad computers, electronic pads, readers, electronic readers, hand-held devices, wireless devices, web devices, web-sites, palm tops, palm pilots, pocket computers, pocket-sized computers, portable consoles, game consoles, portable game consoles, play stations, gaming devices, mobile devices, personal mobile devices, personal information managers, personal digital assistants (PDAs), beepers, pagers, phones, mobile phones, cell phones, smart phones, televisions, kiosks, scorecards, scoreboards, and/or the like, such as, for example, by software, programming applications, downloadable instructions, and/or the like, in combination with appropriate hardware.

Alternatively, one skilled in the art will recognize that, in various embodiments, the inventive arrangements are realized in software, hardware, firmware, communicationware, cloudware, and/or the like, and/or in various combinations thereof. In one embodiment, a representative visualization tool according to the inventive arrangements is realized in a centralized fashion over one computer system 84, or, alternatively, in a distributed fashion in which multiple elements and components are spread over multiple, interconnected computer systems 84. Moreover, any kind of computer system 84, or other apparatus, adapted for carrying out the inventive arrangements described herein is suited. One typical combination of hardware and software, for example, is a general purpose computer system 84 with a computer program that, upon loading and execution, controls the computer system 84 such that the inventive arrangements described herein are carried out. In various embodiments, the inventive arrangements are also embedded in a computer program product comprising the features of an enabling implementation of the inventive arrangements described herein, and which, upon being loaded and executed by the computer system 84, thus carries out the inventive arrangements.

In still other embodiments (not particularly shown), the inventive arrangements are implemented at, or on, one or more of the following: parlor games, game boards, studio game shows, television game shows, cable television shows, and/or lottery tickets, such as scratch-off lottery tickets. Such adaptions are readily carried out as a chosen matter of suitable design choice by those skilled in such arts.

In accordance with the foregoing, one technical effect is enhanced card play, and more specifically, an inventive poker variety thereof according to the inventive arrangements.

Accordingly, it should be readily apparent that this specification describes illustrative, exemplary, representative, and non-limiting embodiments of the inventive arrangements. Accordingly, the scope of the inventive arrangements is not limited to any of these embodiments. Rather, various details and features of the embodiments were disclosed as required. Thus, many changes and modifications, as readily apparent to those skilled in these arts, are within the scope of the inventive arrangements without departing from the spirit hereof, and the inventive arrangements are inclusive thereof. Accordingly, to apprise the public of the scope and spirit of the inventive arrangements, the following claims are made below.

What is claimed is:

1. A method of managing play of a wagering game with a gaming device and at least one player, comprising:

detecting placement of an ante wager associated with the at least one player to participate in the wagering game;

displaying a selected number of randomized playing cards from a set of playing cards with the gaming device, the selected number of randomized playing cards associated with the at least one player;

displaying a selected number of randomized playing cards from the set of playing cards equal to the selected number of playing cards associated with the at least one player with the gaming device, the selected number of randomized playing cards associated with a dealer;

displaying a selected number of randomized common playing cards from the set of playing cards face-down to a common card area with the gaming device;

detecting by the gaming device one discarded playing card from the set of playing cards associated with the at least one player, leaving a reduced set of playing cards associated with the at least one player;

detecting by the gaming device one of folding or placing a first play wager associated with the at least one player, the first play wager selected from a first set of multiples of the ante wager;

displaying by the gaming device a first common playing card from the selected number of randomized common playing cards;

detecting by the gaming device one of folding or placing of a second play wager associated with the at least one player, the second play wager comprising a second set of multiples of the ante wager comprising a highest multiple that is less than a highest multiple of the first set of multiples of the ante wager;

displaying by the gaming device a second common playing card from the selected number of randomized common playing cards;

detecting by the gaming device one of folding or placing of a third play wager associated with the at least one player, the third play wager selected from a third set of multiples of the ante wager comprising a highest multiple that is less than the highest multiple of the second set of multiples of the ante wager;

determining by the gaming device a best poker hand from the reduced set of playing cards and the selected number of common playing cards;

determining by the gaming device a best poker hand from the selected number of playing cards associated with the dealer and the selected number of common playing cards; and resolving the first play wager, the second play wager, and the third play wager with the gaming device.

2. The method of claim 1, further comprising selecting the selected number of playing cards associated with the at least one player and the dealer to comprise four playing cards, the reduced set of playing cards to comprise three playing cards, and the selected number of common playing cards to comprise three playing cards.

3. The method of claim 2, wherein determining a best poker hand from the reduced set of playing cards and the selected number of common playing cards comprises selecting a best five-card poker hand from the three playing cards of the reduced set of playing cards and the three common playing cards, and wherein determining a best poker hand from the selected number of playing cards associated with the dealer comprises selecting a best five-card poker hand from the four playing cards associated with the dealer and the three common playing cards.

4. The method of claim 1, further comprising, upon detecting the placing of the third play wager, displaying a third common playing card of the selected number of randomized common playing cards after the step of detecting one of folding or placing of a third play wager associated with the at least one player.

5. The method of claim 1, further comprising selecting the first set of multiples from the group consisting of one times the ante wager, two times the ante wager, three times the ante wager, and four times the ante wager.

6. The method of claim 5, further comprising selecting the second set of multiples from the group consisting of one times the ante wager, two times the ante wager, and three times the ante wager.

7. The method of claim 6, further comprising selecting the third set of multiples from the group consisting of one times the ante wager and two times the ante wager.

8. The method of claim 1, wherein resolving the first play wager, the second play wager, and the third play wager comprises paying the first play wager, the second play wager, and the third play wager if the best poker hand associated with the at least one player is better than the best poker hand associated with the dealer according to a poker hand hierarchy.

9. The method of claim 1, wherein resolving the first play wager, the second play wager, and the third play wager comprises taking the ante wager, the first play wager, the second play wager, and the third play wager if the best poker hand associated with the dealer is at least one of equal to and better than the best poker hand of the at least one player according to a poker hand hierarchy.

10. The method of claim 1, further comprising paying the ante wager according to a paytable if the best poker hand associated with the at least one player is better than the best poker hand associated with the dealer according to a poker hand hierarchy.

11. The method of claim 10, wherein paying the ante wager comprises requiring that the best poker hand associated with the at least one player be a straight or better according to the poker hand hierarchy.

12. The method of claim 1, further comprising enabling the at least one player to place a side wager.

13. The method of claim 12, wherein enabling the at least one player to place a side wager comprises requiring that the side wager is placed before dealing any playing cards from the set of playing cards.

14. The method of claim 12, further comprising paying the side wager according to a paytable based on the best poker hand associated with the at least one player if the best poker hand associated with the dealer is better than the best poker hand associated with the at least one player according to a poker hand hierarchy.

15. The method of claim 1, further comprising paying the at least one player a predetermined ratio on the first play wager, the second play wager, and the third play wager.

16. The method of claim 15, further comprising selecting the predetermined ratio to be 1:1.

17. The method of claim 1, further comprising, if the best poker hand associated with the at least one player is better than the best poker hand associated with the dealer according to a poker hand hierarchy, paying the at least one player 1:1 on the first play wager, the second play wager, and the third play wager.

18. A method of managing play of a wagering game with a computer system with at least one player, the method comprising:

detecting with the computer system placement of an ante wager associated with the at least one player to participate in the wagering game using at least one input interface of the computer system;

allocating with the computer system a plurality of randomized player playing cards from a set of playing cards to the at least one player;

allocating with the computer system a plurality of randomized dealer playing cards from the set of playing cards to a dealer;

allocating with the computer system a plurality of randomized common playing cards from the set of playing cards;

in a first wagering round:

displaying on at least one display element of the computer system the plurality of player playing cards from the set of playing cards; and detecting with the computer system one of folding or placing a first play wager associated with the at least one player and selected from a first set of multiples of the ante wager using the at least one input interface of the computer system;

displaying on the at least one display element of the computer system a first common playing card of the plurality of common playing cards;

upon displaying the first common playing card of the plurality of common playing cards, in a second wagering round, detecting with the computer system one of folding or placing a second play wager associated with the at least one player and selected from a second set of multiples of the ante wager comprising a highest multiple that is less than a highest multiple of the first set of multiples of the ante wager using the at least one input interface of the computer system;

displaying on the at least one display element of the computer system a second common playing card of the plurality of common playing cards;

upon displaying the second common playing card of the plurality of common playing cards to the at least one player, in a third wagering round, detecting with the computer system one of folding or placing a third play wager associated with the at least one player and selected from a third set of multiples of the ante wager comprising a highest multiple that is less than the highest multiple of the second set of multiples of the ante wager using the at least one input interface of the computer system;

displaying on the at least one display element of the computer system a third common playing card of the plurality of common playing cards;

determining with the computer system a best poker hand for the at least one player from the plurality of player playing cards and the plurality of common playing cards;

determining with the computer system a best poker hand for the dealer from the plurality of dealer playing cards and the plurality of common playing cards; and resolving the first play wager, the second play wager, and the third play wager with the computer system.

19. The method of claim 18, further comprising detecting one discarded playing card from the plurality of player playing cards using the at least one input interface of the computer system before displaying the first common playing card of the plurality of common playing cards.

20. The method of claim 18, further comprising:

selecting the first set of multiples to consist of one times the ante wager, two times the ante wager, three times the ante wager, and four times the ante wager;

selecting the second set of multiples to consist of one times the ante wager, two times the ante wager, and three times the ante wager; and selecting the third set of multiples to consist of one times the ante wager and two times the ante wager.

21. The method of claim 18, further comprising, if the best poker hand associated with the at least one player is better than the best poker hand associated with the dealer according to a poker hand hierarchy, paying the at least one player 1:1 on the first play wager, the second play wager, and the third play wager.

22. The method of claim 18, further comprising paying the ante wager according to a paytable if the best poker hand associated with the at least one player is better than the best poker hand associated with the dealer according to a poker hand hierarchy.

23. A system comprising:

at least one input interface;

at least one display; and a non-transitory device-readable storage medium containing device-executable code for managing play of a wagering game with at least one player comprising:

detecting placement of an ante wager associated with at least one player with the at least one input interface to participate in the wagering game;

displaying a selected number of randomized virtual playing cards from a set of virtual playing cards associated with the at least one player;

allocating a selected number of randomized virtual playing cards from the set of virtual playing cards equal to the selected number of virtual playing cards associated with the at least one player to a virtual dealer card set;

allocating a selected number of randomized common virtual playing cards from the set of virtual playing cards to a common card set;

detecting one discarded virtual playing card of the selected number of virtual playing cards from the set of virtual playing cards associated with the at least one player with the at least one input interface leaving a reduced set of virtual playing cards;

in a first wagering round, detecting one of folding or placing a first play wager associated with the at least one player and selected from a first set of multiples of the ante wager with the at least one input interface;

displaying a first common playing card from the common card set;

upon displaying the first common playing card from the common card set, in a second wagering round, detecting one of folding or placing a second play wager associated with the at least one player and selected from a second set of multiples of the ante wager comprising a highest multiple that is less than a highest multiple of the first set of multiples of the ante wager with the at least one input interface;

displaying a second common playing card from the common card set;

upon displaying the second common playing card from the common card set, in a third wagering round, detecting one of folding or placing a third play wager associated with the at least one player and selected from a third set of multiples of the ante wager comprising a highest multiple that is less than the highest multiple of the second set of multiples of the ante wager using the at least one input interface;

displaying a third common playing card from the common card set;

determining a best poker hand associated with the at least one player from the reduced set of virtual playing cards and the common card set;

determining a best poker hand associated with a virtual dealer from the virtual dealer card set and the common card set;

displaying the best poker hand associated with the at least one player and the best poker hand associated with the virtual dealer with the at least one display; and resolving the first play wager, the second play wager, and the third play wager and displaying the results.

24. The system of claim 23, wherein the device-executable code for managing play of the wagering game with the at least one player further comprises, if the best poker hand associated with the at least one player is better than the best poker hand associated with the virtual dealer according to a poker hand hierarchy, paying the at least one player 1:1 on the first play wager, the second play wager, and the third play wager.

* * * * *